US008380055B1

(12) United States Patent
Bridegum

(10) Patent No.: US 8,380,055 B1
(45) Date of Patent: Feb. 19, 2013

(54) ANODES FOR WATER HEATER AND STORAGE TANKS

(76) Inventor: James E. Bridegum, Penn Valley, CA (US)

( * ) Notice: Subject to any disclaimer, the term of this patent is extended or adjusted under 35 U.S.C. 154(b) by 275 days.

(21) Appl. No.: 12/942,739

(22) Filed: Nov. 9, 2010

Related U.S. Application Data

(60) Provisional application No. 61/406,451, filed on Oct. 25, 2010.

(51) Int. Cl.
*F24H 1/18* (2006.01)
*F24H 1/20* (2006.01)
*C23F 13/00* (2006.01)

(52) U.S. Cl. ..... 392/441; 392/447; 204/196.3

(58) Field of Classification Search ..... 392/441, 392/447, 448; 219/523; 204/196.1–196.19, 204/196.29, 196.3–196.32
See application file for complete search history.

(56) References Cited

U.S. PATENT DOCUMENTS

| | | | | | |
|---|---|---|---|---|---|
| 629,092 | A | * | 7/1899 | Ross | 204/196.19 |
| 2,656,314 | A | * | 10/1953 | Osterheld | 204/196.11 |
| 2,779,729 | A | * | 1/1957 | Jorgensen | 204/196.11 |
| 3,558,463 | A | * | 1/1971 | Strobach | 204/196.18 |
| 3,657,084 | A | * | 4/1972 | Beer et al. | 205/733 |

* cited by examiner

*Primary Examiner* — Sang Paik
(74) *Attorney, Agent, or Firm* — Lewis and Roca LLP

(57) ABSTRACT

A replacement anode assembly for a hot water heater or storage tank includes an anode body formed from an anode material, a magnet mechanically coupled to a first end of the anode body, and a grounding wire electrically coupled to the anode body.

11 Claims, 4 Drawing Sheets

ANODES FOR WATER HEATER AND STORAGE TANKS

CROSS REFERENCE TO RELATED APPLICATIONS

This application claims the benefit of U.S. Provisional Patent Application Ser. No. 61/406,451, filed Oct. 25, 2010, the entirety of which is incorporated by reference herein.

BACKGROUND

Ever since the advent of glass lined commercial water heaters in the early 1960s, water heater end users as well as water heater manufacturers have sought methods of increasing the lives of glass lined tanks. Although the life of glass lined tanks is longer than galvanized tanks previously used, the savings have been more than offset by the higher initial costs for the water heaters brought about by new safety and efficiency requirements mandated by some states as well as the Federal Government.

To ensure that water heater tanks will last through the warranty periods all manufacturers install anodes in the tanks. Anodes for water heater tanks can be magnesium, aluminum, or zinc. The anode is a sacrificial rod that coats bare areas that may exist or come to exist within a water heater tank as glass erodes in a normal attrition process. As anodes coat the bare areas in the tanks they become depleted. Once the anodes are depleted the tanks are destined to fail in less than a year. For this reason many people desire to extend the lives of the tanks by replacing the depleted anodes after the tank warranties expire.

In an effort to convince end users that they can extend the lives of the water heater tanks beyond the warranty periods, manufacturers make some of the anodes somewhat accessible. Anodes have been made accessible in the top of the tanks so that consumers can replace anodes if they desired to do so. Anode suppliers also offer link type anodes to be inserted in fittings on the side walls of the tanks near the tops of the tanks. However, very few tanks have these extra fittings. When the tanks do have them, the fittings are usually inaccessible once the water heaters are installed.

To also ensure that tanks will last through the warranty period, all manufacturers install hand hole cleanouts so that the excessive lime that builds up in the tanks can be removed. All manufacturers now require that the hole clean out plates which are easy to remove and re-install, be removed so that the lime and sediment build up can be removed from the tanks on a regular basis.

While providing access to some of the anodes for replacement has helped a small number of end users, it has not been of significant help to most end users due to the fact that the anodes are very difficult to remove after the water heaters are in service for a few years. Prior to the present invention, there has been no way to install replacement anodes in many of the existing water heater tanks without completely disconnecting the entire water heater and then disassembling the vents, jacket tops and often the flue collectors because the anodes are often located underneath the flue collectors. Removing the flue collectors to replace anodes is a major task and in most cases it is extremely difficult to do so without damaging the water heaters and rendering them unsafe.

After disassembly has been accomplished, the user must then attempt to remove the old anodes. In most cases the anodes cannot be removed because of corrosion of the fittings. People attempting to replace the depleted anodes also often damage the flue collectors and flue collector sealants.

Consequently, the end users cannot replace the anodes without hiring plumbing contactors and in many cases even the plumbers cannot remove depleted anodes and replace them with new anodes.

For these reasons people are resigned to the fact that they cannot replace the anodes on most of the most expensive commercial water heaters in the field today and they no longer attempt to do so without calling a professional plumbing company that specializes is such work and even these companies cannot remove and replace many of the anodes. This professional service also costs too much to make it a practical solution As a result, most of the more expensive commercial water heaters fail several years sooner than they would if replacement anodes could be installed.

BRIEF DESCRIPTION

The present invention now solves this problem by offering a replacement anode and a method of installing replacement anodes in all water heater tanks or storage tanks in the field.

According to a first aspect of the present invention, a replacement anode for water heaters and storage tanks is provided. In some embodiments, the anode is mounted to the wall of the water heater or storage tank, or to the cover plate for the hand-hole cleanout using a magnet. In other embodiments the replacement anode may be mounted to the wall of the water heater or storage tank, or to the cover plate for the hand-hole cleanout using other fastening means, such as bolts or snap-in fasteners. A wire is provided for making an electrical connection to the body of the hot water heater or storage tank. In some embodiments, the replacement anode is merely placed in the tank and electrically coupled to the body of the tank with a wire.

According to another aspect of the present invention, a method for replacing a depleted anode in a hot water heater or storage tank is disclosed. According to this method, the replacement anode is either placed in or mounted to the inner wall of the hot water heater or storage tank or to the cover plate of a hand-hole cleanout provided in the hot water heater or storage tank.

BRIEF DESCRIPTION OF THE DRAWING FIGURES

DETAILED DESCRIPTION

Persons of ordinary skill in the art will realize that the following description of the present invention is illustrative only and not in any way limiting. Other embodiments of the invention will readily suggest themselves to such skilled persons.

Figure 1:
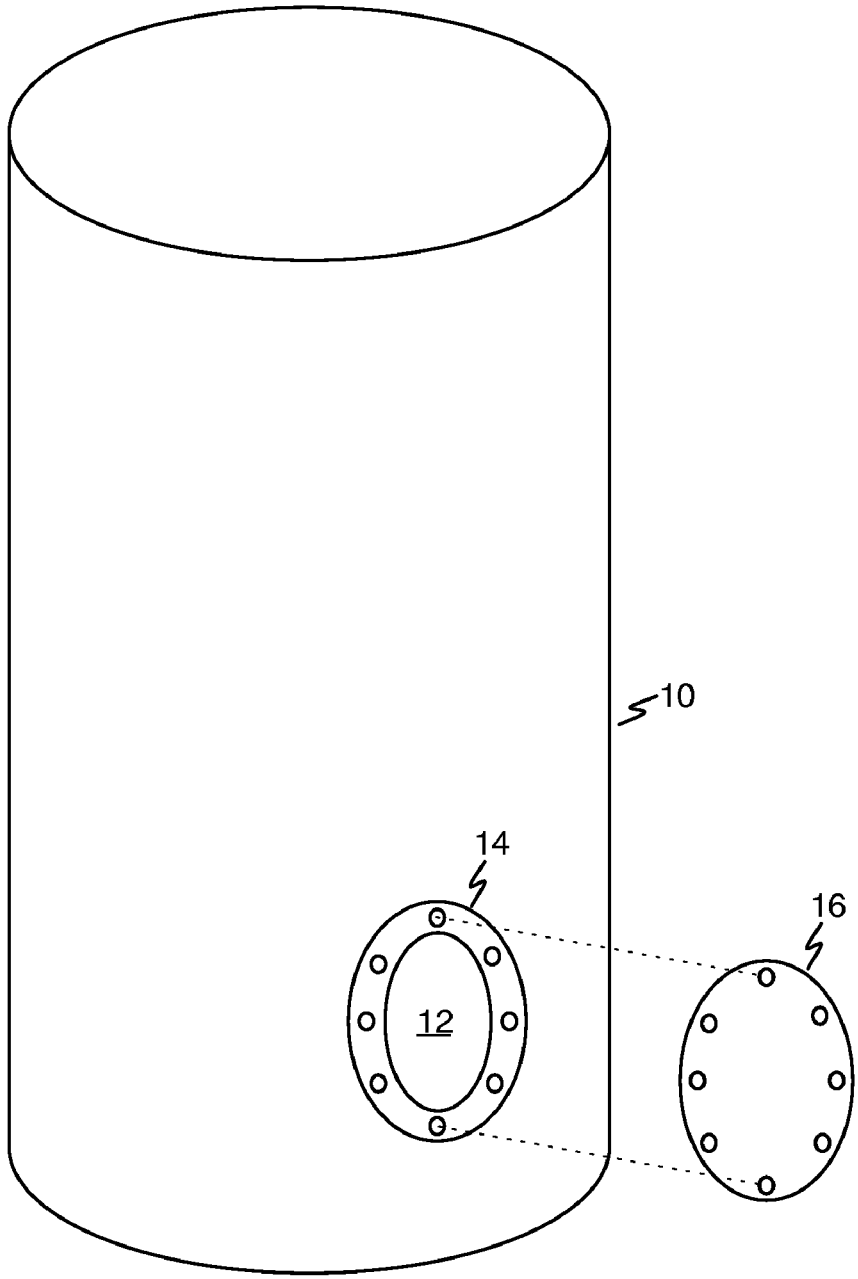
FIG. 1 is a diagram showing a typical commercial gas water heater equipped with a hand-hole cleanout.

Referring first to FIG. 1, a diagram shows the tank wall 10 of a typical commercial water heater equipped with a hand-hole cleanout 12 bordered by peripheral hand hole ring 14. A cover plate 16 is fastened over the hand-hole cleanout 12 by bolts engaging with threaded holes in hand hole ring 14. Persons of ordinary skill in the art will appreciate that while FIG. 1 depicts a gas fired water heater, the present invention allies equally to hot water heaters that heat water using an electrical heating element and to storage tanks as well.

Figure 2:
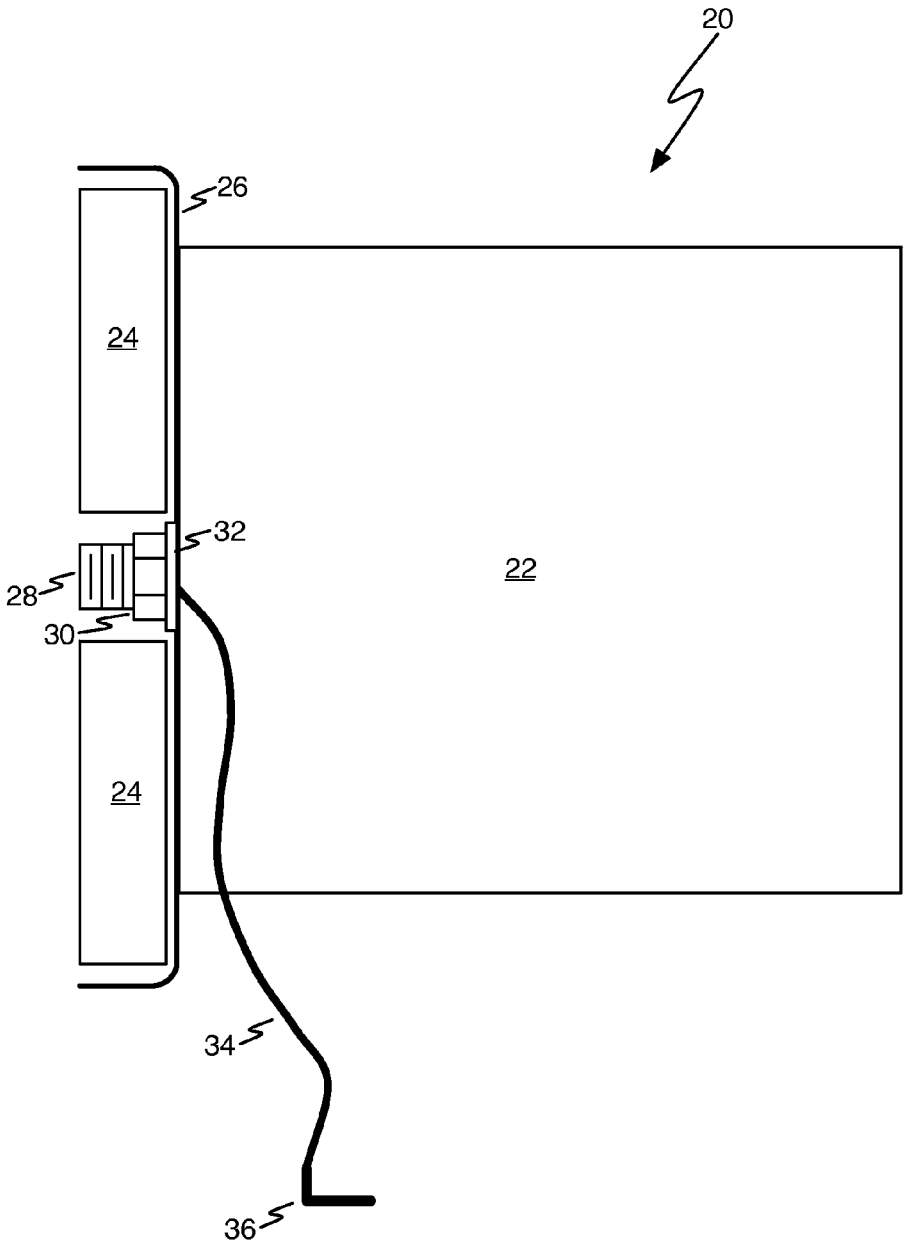
FIG. 2 is a diagram showing an illustrative magnet and replacement anode assembly according to one embodiment of the present invention.

Referring now to FIG. 2, a diagram shows a cross-sectional view of an illustrative replacement anode and magnet assembly 20 that may be used with a water heater 10 of FIG. 1 in accordance with one embodiment of the present invention. Assembly 20 includes replacement anode body 22. Replacement anode body 22 can be formed from any known anode material such as magnesium, aluminum, or zinc, and may be provided in a variety of dimensions. As presently preferred, replacement anode body 22 may have a diameter of about 2 inches. In one embodiment, replacement anode body 22 may have a diameter of 2.5 inches and a length of between about 4 inches and 5 inches. Such dimensions will result in an anode surface area of between about 16 and about 26 square inches. The actual size of a replacement anode 22 is a matter of design choice and may be dictated by factors such as the available internal volume of the tank of water heater or storage tank 10 and the number of flue tubes in the tank.

Replacement anode body 22 is mechanically coupled to magnet 24. According to one illustrative embodiment of the present invention shown in FIG. 2, magnet 24 may be a ring magnet including a steel shell 26, having a hole through which a threaded stud 28 provided on one end of replacement anode body 22. The hole provided in steel shell 26 may be internally threaded to mate with threads on threaded stud 28 or a nut 30 with or without a washer 32 may be employed to fasten threaded stud 28 of replacement anode body 22 to steel shell 26. Steel shell 26 may be bonded to magnet 24 using a bonding substance or may be held thereto by magnetic force exerted by magnet 24. Persons of ordinary skill in the art will appreciate that while the principles of the present invention are shown using a ring magnet, other magnet shapes could be employed without departing from the inventive concepts disclosed herein. Further, such skilled persons will appreciate that the magnet 24 may be attached to the core of the replacement anode body 22 by employing screws, nuts bolts, pins, etc., or by such means as providing a hook or clip on the magnet from which the replacement anode body 22 may be suspended. Every type of fastener that can be employed is considered to be within the scope of the present invention.

A grounding wire 34 is electrically coupled to replacement anode body 22, either at threaded stud 28 or otherwise connected to the bulk of replacement anode body 22. A connecting clip or terminal 36 can be provided at the distal end of grounding wire 34.

According to other embodiments of the present invention, the replacement anode body 22 is not mounted to the tank wall 10 or to the hand hole cleanout cover plate 16 of FIG. 1. The replacement anode will function so long as an electrical connection is made between the replacement anode body 22 and the metal from which the tank is formed.

Figure 3:
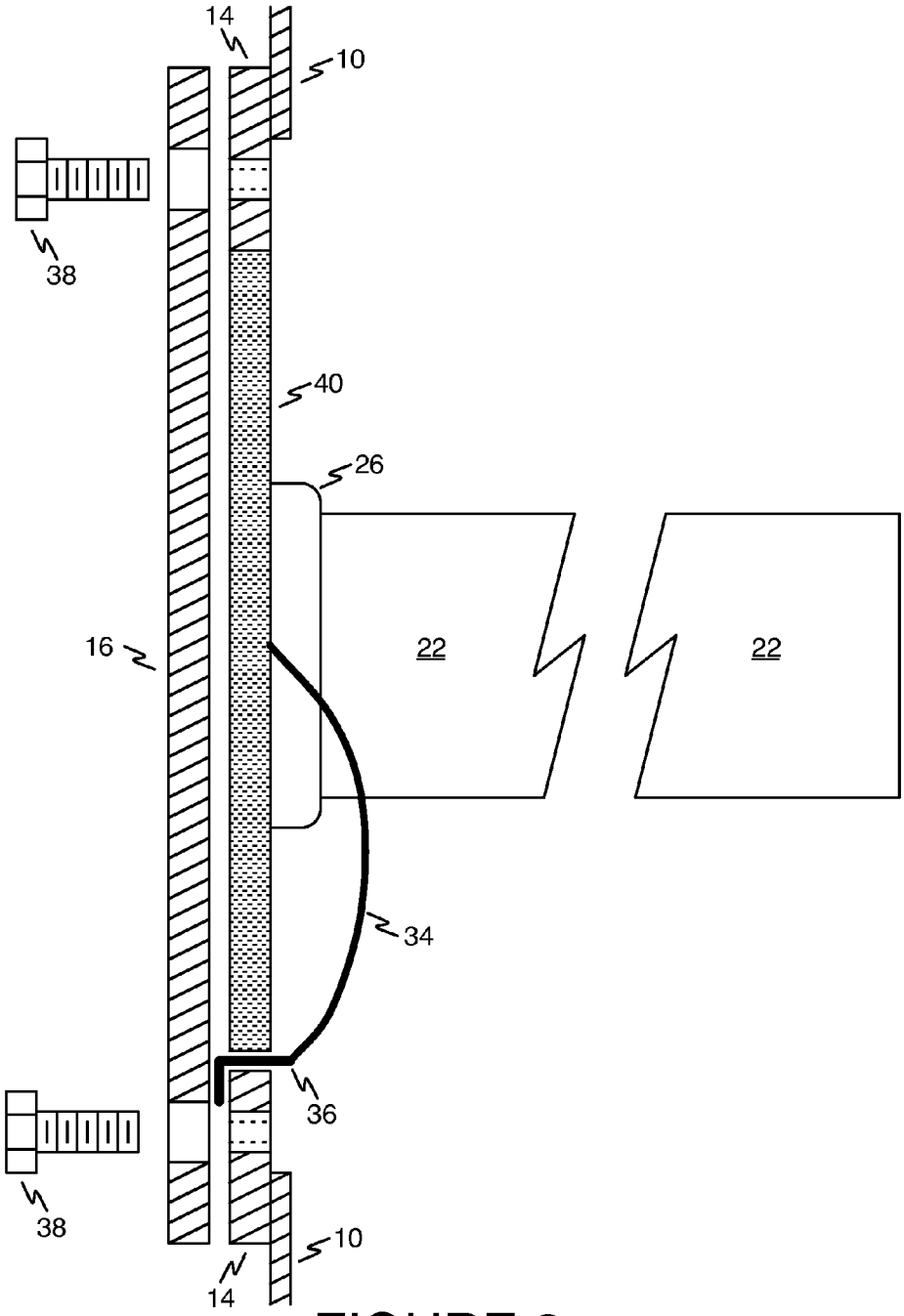
FIG. 3 is a diagram showing an illustrative method of electrically coupling a replacement anode to the metal tank wall in accordance with the present invention.

Referring now to FIG. 3, a diagram shows an illustrative method of electrically coupling a replacement anode to the metal tank wall 10 in accordance with the present invention. To install replacement anode and magnet assembly 20 in a hot water heater or storage tank such as tank 10 of FIG. 1, cover plate 16 is removed from the hand-hole cleanout 12 by removing the bolts 38 that hold it in place. The replacement anode and magnet assembly 20 is then attached to the inside surface of cover plate 16 or the inside of the tank wall 10 using the magnetic force exerted by magnet 24. In some applications, replacement anode and magnet assembly 20 may be attached to the inner surface 36 of the tank wall 10 instead of to the inside of the cover plate 16.

The cover plate 14 is then pressed against the hand hole ring 14 welded to tank wall 10 after a hand hole gasket 40 has been installed. The clip or terminal 36 at the end of grounding wire 34 is positioned to make electrical contact with either one of bolts 38 or with a bare steel surface on hand hole ring 14 or cover plate 16. Bolts 34 are then tightened to attach cover plate 16 to the hand hole ring 14 and make the electrical connection from replacement anode body 22 to the steel body of tank wall 10.

Figure 4:
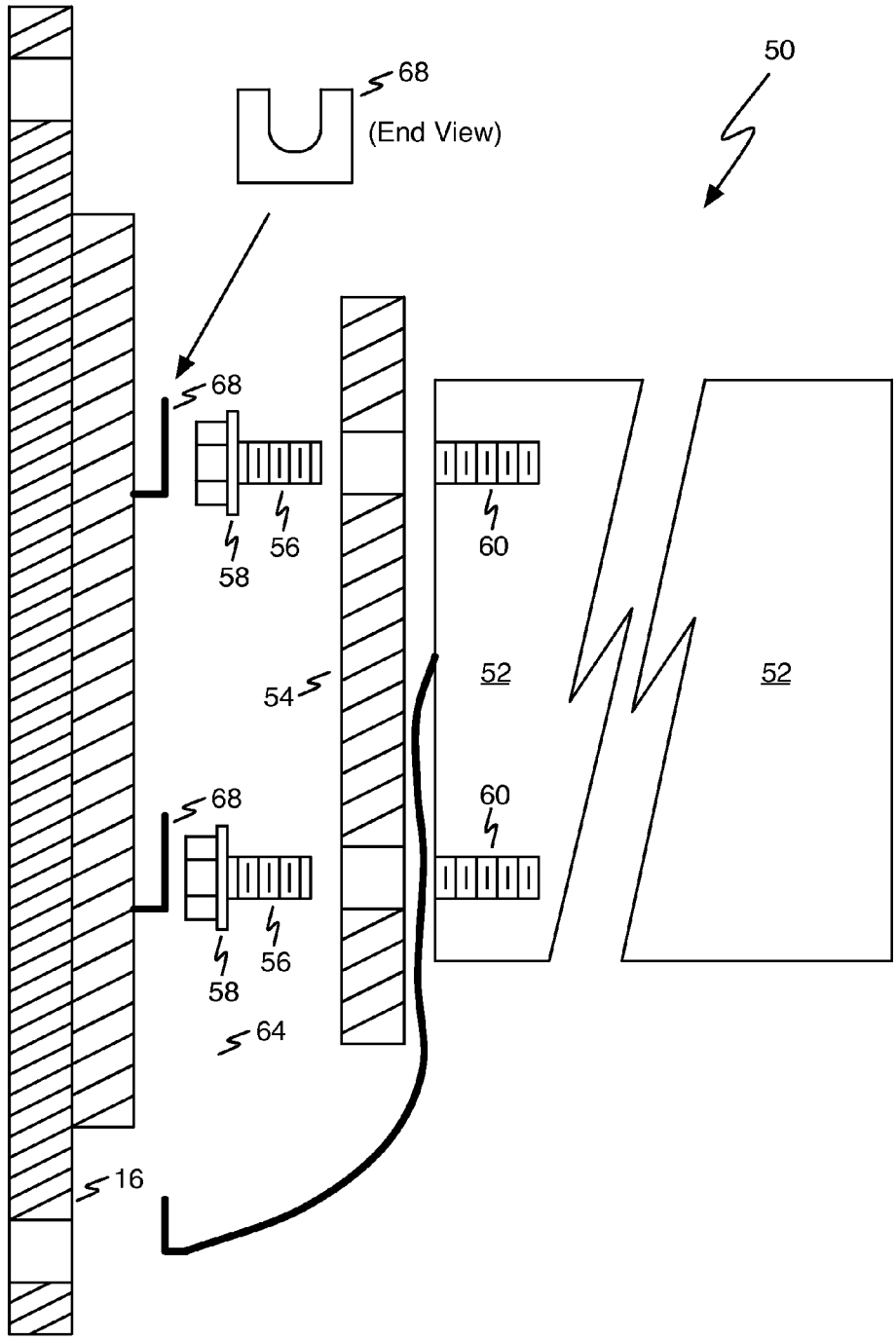
FIG. 4 is a diagram showing an illustrative alternate method of mounting a replacement anode to the cover plate of a hand-hole cleanout or to the inner tank wall in a water heater in accordance with the present invention.

Referring now to FIG. 4, a diagram shows an illustrative magnet and replacement anode assembly according to another embodiment of the present invention. Replacement anode assembly 50 includes replacement anode body 52 mechanically coupled to a disc 54 formed from a material such as rubber, nylon, or other synthetic material. Disc 54 may be fastened to replacement anode body 52 using bolts 56 (and optional washers 58) passed through holes in disc 54 and engaged into female threaded holes 60 formed in replacement anode body 52. Alternatively, disc 54 may be bonded to the end of replacement anode body 52 by use of an adhesive.

Grounding wire 62, electrically coupled to the core of replacement anode body 52 is also provided. Grounding wire 62 may optionally be provided with a terminal or connecting clip 64 at its distal end.

Replacement anode assembly 50 may be attached to the inside of hand hole cover plate 16 of tank 10 of FIG. 1 using an adhesive material or by other means. As with the embodiment shown in FIG. 2, replacement anode assembly 50 may also be attached to the inside of the tank wall using an adhesive material or by other means. The attachment means include, but not limited to, such means as providing an attachment coupling, such as a stud, a threaded post, a threaded hole, a clip or other similar means on the inside of cover plate 16 or the tank wall 10. According to one embodiment, a second disc 66 having clips 68 that engage the heads of bolts 56 is fastened to the inside surface of cover plate 16.

The present invention fulfills a hitherto unmet need for end users such as apartment owners, restaurant owners, laundromat owners, etc. by providing them with the opportunity to easily install a replacement anode of a much larger diameter and to easily replace it periodically when water conditions and high volume hot water heater usage make it necessary.

The installation of the replacement anodes described herein is easily accomplished through the hand hole clean out openings because these covers need to be opened periodically for normal tank maintenance. Manufacturers generally require that these covers be removed periodically for lime removal in order to maintain the validity of the warranties. Once the hand hole cover plate is removed, the replacement anode can easily be installed by merely placing the magnet to which the anode is attached against the inside surface of the tank sheet or the middle of the hand hole cleanout plate itself if sufficient clearance exists to permit the anode to fit between the flues. Otherwise the replacement anode may be placed on the inner tank wall in any area that can be reached through the hand hole opening.

In an alternative embodiment, steel, rubber, nylon or other synthetic material can be substituted for the magnet and may be attached to the hand hole plate or the inner surface of the tank wall with the use of an adhesive.

To extend the lives of water heaters, the invention offers a simple method of installing replacement anodes in all existing water heater tanks. According to the invention, the replacement anodes can be attached directly to the tanks or they can make contact indirectly with a separate ground wire. Conventional type anodes that break off from their fittings and lose their ground connections will not function after they lose electrical contact with the tanks. The ends of the replacement anodes illustrated in the drawings herein make contact with the tank through the metal casing covering the magnet, but the anodes may also make contact with the tank in some cases with a separate grounding wire shown in the drawing figures. The grounding wire can be used to ensure better contact if the porcelain tank lining is too heavy and acts as an insulator thereby preventing the metal casing from making contact with the tank wall.

The connection for the tank ground may be made directly with the end of the wire or by use of a clip or terminal as shown in the drawings. The bare portion of the insulated wire makes contact with the tank when it is placed between the hand hole clean out gasket and the tank sheet or the hand hole clean out gasket and the hand hole cover plate. In an alternative embodiment, the anodes may be grounded by running a small insulated wire through the hand hole cleanout wherein can be attached to one of the bolts. All methods of grounding are considered to be equivalent for the purposes of the present invention.

Attaching a replacement anode to the tank wall inside the hand hole clean out plate or to the hand hole clean out plate itself is a major advantage of the present invention. With the technology employed in the present invention, replacement anodes can easily be installed in all commercial water heaters and storage tanks by merely removing the hand hole cleanout plates that may be easily removed using a hand wrench. The replacement anode can then be installed on the inside wall of the tank at a location where the anode has sufficient space to fit between the flues.

The method of the present invention permits a replacement to be installed in all existing tanks in the field. Given that there have been hundreds of different models of commercial tanks that have been manufactured over the years there is not a specific location on all of the tanks that would permit sufficient clearance to install an anode because the flues are in different locations on all commercial tanks. The present invention overcomes this obstacle and offers a method of installing replacement anodes for all commercial water heaters with hand hole clean out openings. Use of the present invention, the ability to provide replacement anodes provide extended protection against corrosion and thereby extend the lives of the tanks.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A replacement anode assembly for a hot water heater or storage tank including:

an anode body formed from an anode material;

a magnet mechanically coupled to a first end of the anode body;

a grounding connection electrically coupled to the anode body;

a shell formed at least partially over the magnet, the shell including a hole formed therethrough; and a threaded stud extending axially from the first end of the anode body, the threaded stud coupling the shell to the anode body.

2. The replacement anode assembly of claim 1 wherein the anode body includes a threaded stud extending axially from its first end and the magnet is coupled to the anode body by a nut engaged with the stud.

3. The replacement anode assembly of claim 1 wherein the threaded stud the threaded stud passes through the hole formed through the shell and is coupled to the shell with a nut engaged on the stud.

4. The replacement anode assembly of claim 1 wherein the threaded stud the threaded stud passes through the hole formed through the shell and is coupled to the shell by mating threads formed in the hole formed through the shell.

5. The replacement anode assembly of claim 1 wherein the magnet is a ring magnet.

6. The replacement anode assembly of claim 1 wherein the grounding connection comprises a grounding wire.

7. The replacement anode assembly of claim 6 further including a connector at a distal end of the grounding wire.

8. A method for installing a replacement anode in a hot water heater or storage tank including:

removing a cover plate from a hand hole cleanout formed in a wall of the hot water heater or storage tank;

magnetically attaching a replacement anode assembly to one of an inside face of the cover plate and an inside wall of the hot water heater or storage tank;

electrically coupling a grounding wire from the replacement anode to an exposed metal surface on one of the cover plate and an edge of the hand hole cleanout; and replacing the cover plate over the hand hole cleanout.

9. The method of claim 8 wherein electrically coupling a grounding wire from the replacement anode to an exposed metal surface on one of the cover plate and an edge of the hand hole cleanout comprises positioning a distal end of the grounding wire between an inside edge of the cover plate and an exposed metal region of a hand hole ring defining the hand hole cleanout.

10. The method of claim 8 wherein magnetically attaching a replacement anode assembly to one of an inside face of the cover plate and an inside wall of the hot water heater or storage tank comprises magnetically attaching a replacement anode assembly to an inside face of the cover plate.

11. The method of claim 8 wherein magnetically attaching a replacement anode assembly to one of an inside face of the cover plate and an inside wall of the hot water heater or storage tank comprises magnetically attaching a replacement anode assembly to an inside wall of the hot water heater.

* * * * *